United States Patent [19]

Shaw et al.

[11] Patent Number: 4,722,529

[45] Date of Patent: Feb. 2, 1988

[54] GOLF BALLS

[75] Inventors: Michael Shaw; Brian F. Machin, both of Wakefield, England

[73] Assignee: Dunlop Limited, United Kingdom

[21] Appl. No.: 861,344

[22] Filed: May 9, 1986

[30] Foreign Application Priority Data

Jun. 5, 1985 [GB] United Kingdom ..... 8514208

[51] Int. Cl.[4] ..... A63B 37/14

[52] U.S. Cl. ..... 273/232

[58] Field of Search ..... 273/232, 233, 235 R

[56] References Cited

U.S. PATENT DOCUMENTS

| | | | |
|---|---|---|---|
| 878,254 | 2/1908 | Taylor | 273/232 |
| 3,819,190 | 6/1974 | Nepeal et al. | 273/232 |
| 4,090,716 | 5/1978 | Martin et al. | 273/232 |
| 4,142,727 | 3/1979 | Shaw et al. | 40/327 X |
| 4,258,921 | 3/1981 | Worst | 273/232 |

FOREIGN PATENT DOCUMENTS

| | | | |
|---|---|---|---|
| 1381897 | 1/1975 | United Kingdom | 273/232 |
| 1407730 | 9/1975 | United Kingdom | 273/232 |
| 2103939 | 2/1983 | United Kingdom | 273/232 |
| 2117252 | 10/1983 | United Kingdom | 273/232 |

*Primary Examiner*—George J. Marlo

*Attorney, Agent, or Firm*—Stevens, Davis, Miller & Mosher

[57] ABSTRACT

A spherical golf ball (10) is provided with at least 500 dimples and 30 bald patches symmetrically disposed over the surface of the ball, the disposition of the dimples being substantially the same in each of twelve regions (11) of the surface of the sphere which are defined by projecting on to the surface the edges of a regular dodecahedron. At the mid point of each edge of the dodecahedron there is a bald patch (20, 21, 22, 23, 24). Each bald patch has the shape of a spherical rectangular dumbbell, a surface area of from 1.0 to 2.5 times the mean dimple area and does not enclose any dimple or part thereof.

7 Claims, 2 Drawing Figures

GOLF BALLS

This invention relates to golf balls and in particular to the surface configuration of golf balls.

It has long been the practice to provide depressions or indentations (hereinafter "dimples") on the surface of golf balls to enhance their aerodynamic properties.

In our U.K. Pat. No. 1508039 dated 18 Aug. 1976 and its U.S. equivilant Pat. No. 4,142,727, it is disclosed that further aerodynamic advantages can result from the provision of dimple-free areas (hereinafter "bald patches") on the surface of the ball, these bald patches comprising "spherical rectangles" having a surface area of at least twice the "mean dimple area" (all as defined in U.K. Pat. No. 1508039 and its U.S. equivilant Pat. No. 4,142,727).

Since the date of our aforesaid Patent, we have found that yet further improvements in the aerodynamic and other playing properties of golf balls can be achieved by alteration of the number and disposition of the dimples, and hence alteration of the shape, size and disposition of the bald patches, on the surface of the ball.

Accordingly, the present invention provides a golf ball in the shape of a sphere having in its surface a plurality of dimples and having a plurality of bald patches symmetrically disposed on the surface of the ball, a bald patch being any region on the surface of the ball in which it is possible to draw a spherical rectangular dumbbell having a surface area of from 1.0 to 2.5 times the mean dimple area, the spherical rectangular dumbbell not enclosing any dimple or part thereof, the terms "mean dimple area", "spherical rectangular dumbbell" and "surface area" all being as hereinafter defined.

Throughout this description and claims, the following terms have the meanings ascribed to them hereinbelow:

"mean dimple diameter":
- the average of the diameters of all the dimples on the ball "mean dimple area":
- the area on the peripheral surface of the ball occupied by a single dimple having a diameter equal to the "mean dimple diameter", i.e. $\frac{1}{4}$ pi. (mean dimple diameter)$^2$ "spherical rectangular dumbbell:
- a radial projection on to the surface of a sphere of a figure comprising two identical rectangles symmetrically disposed at opposite parallel sides of a third rectangle so that the longitudinal mid plane of the third rectangle makes an angle of 90° with the longitudinal mid planes of the two identical rectangles and the figure has an overall configuration analogous to that of a dumbbell, the sides of the three rectangles thus being arcs of great circles of the sphere.

"surface area":
- the area of that part of the surface of a sphere bounded by the spherical rectangular dumbbell or spherical rectangle.

In a preferred embodiment of the present invention, the disposition of the dimples is substantially the the same in each of those twelve regions of the surface of the sphere which are defined by lines projecting on to the surface the edges of a regular dodecahedron. Each bald patch has the shape of a spherical rectangular dumbbell and will be located at the mid-point of an edge of the dodecahedron. A golf ball according to this embodiment of the present invention will suitably have 500 dimples and 30 bald patches.

The dimples may be circular in plan view and their configuration that of a solid of revolution generated by the rotation of a plane curve about a radius of the ball. Thus, the configuration of the dimples may be that of a part-sphere or a part-ellipsoid.

Suitably, the dimples are circular in plan view and have a diameter in the range 0.085 inches to 0.150 inches (2.16 to 3.81 mm) and preferably a diameter in the range 0.090 inches to 0.145 inches (2.29 to 3.68 mm).

The ratio of the maximum depth of the dimples to their diameter is suitably in the range 1:6 to 1:20.

The present invention will be illustrated by way of the following Example and with reference to the accompanying drawings.

Figure 1:
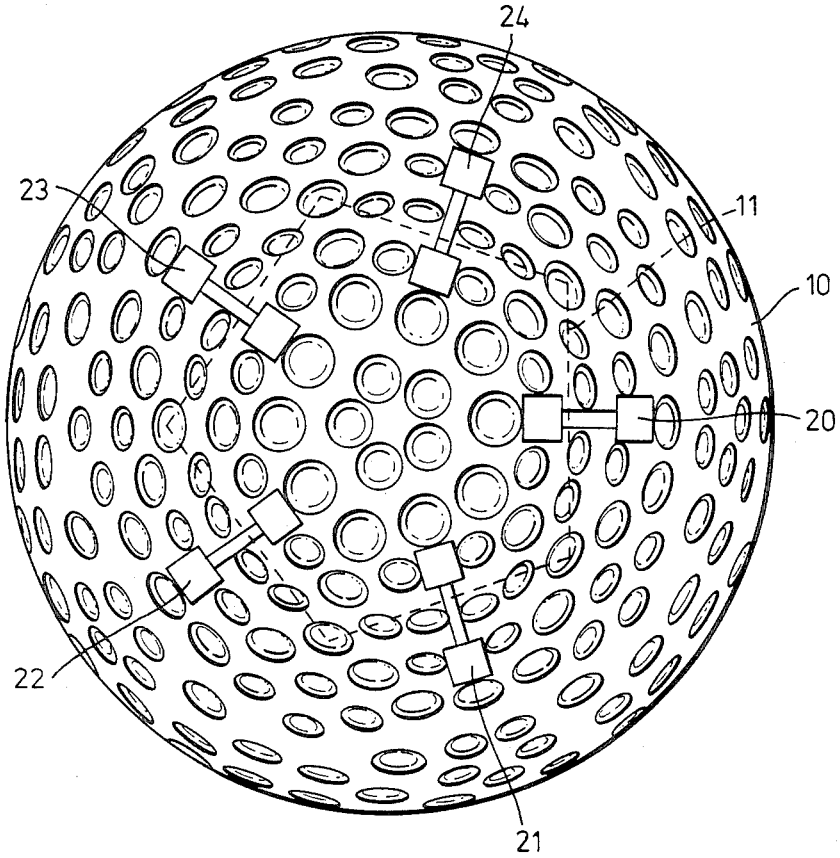
FIG. 1 is a perspective view of a golf ball according to a preferred embodiment of the present invention.
Figure 2:
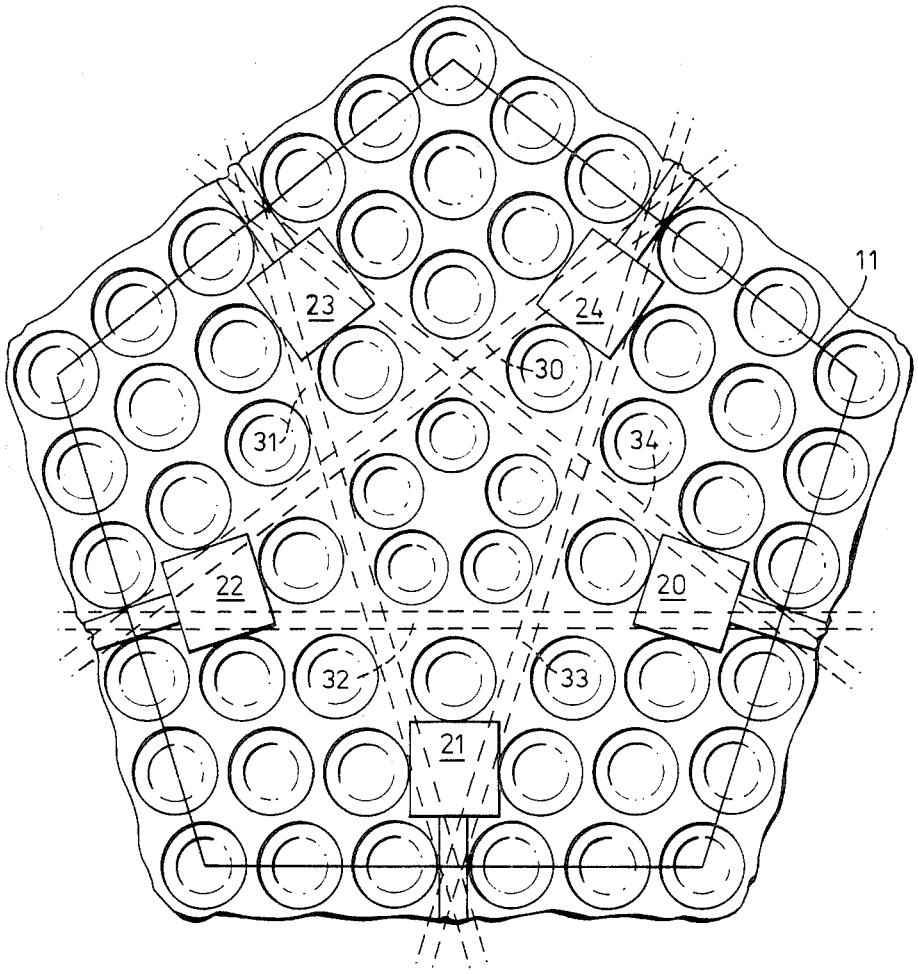
FIG. 2 is an enlarged view of a portion of FIG. 1.

Referring to FIGS. 1 and 2, a golf ball 10 has a dimple configuration which is substantially the same in each of the twelve pentagonally-shaped areas (one only of which is shown, bounded by dotted lines and labelled 11) defined by projecting on to the surface of the ball the edges of a regular dodecahedron. The ball will have a total of thirty bald patches (five are shown, labelled 20,21,22,23 and 24). Each bald patch has the shape of a spherical rectangular dumbbell and is positioned at the mid-point of one of the edges of the dodecahedron.

In FIG. 2, an enlarged view of the pentagonally shaped area 11 of FIG. 1 is shown. The sets of parallel dotted lines 30, 31, 32, 33 and 34 represent seam lines of the ball which lie on great circles of its spherical surface.

A golf ball as illustrated in FIGS. 1 and 2 (i.e. having thirty bald patches, each with the configuration of a spherical rectangular dumbbell) had the following measurements:

(a) Number of dimples=500
(b) Mean dimple area=7.21 mm$^2$
(c) Bald patch area=17.51 mm$^2$
Ratio (c):(b)=2.43

EXAMPLE

Golf balls according to the present invention were tested against other commercially-available golf balls and the results are given below.

GOLF BALL WITH 500 DIMPLES AND 30 BALD PATCHES (SEE FIGS. 1 AND 2 OF DRAWINGS)

| | Carry | | Run | | TOTAL | | TRAJECTORY |
|---|---|---|---|---|---|---|---|
| Ball Type | (yds) | (m) | (yds) | (m) | (yds) | (m) | (degrees) |
| This invention | 229.9 | 210.2 | 20.3 | 18.6 | 250.2 | 228.8 | 10.1 |
| MAXFLI DDH | 227.7 | 208.2 | 17.3 | 15.8 | 245.0 | 224.0 | 10.2 |
| Competitor | 228.6 | 209.0 | 20.3 | 18.6 | 248.9 | 227.6 | 10.5 |
| | Wind: | | Still | Ground: | | Soft | |

We claim:

1. A golf ball in the shape of a sphere having in its surface at least 500 dimples and 30 bald patches symmetrically disposed over the surface of said sphere, the disposition of said dimples being substantially the same in each of those twelve regions of the surface of said sphere which are defined by projecting on to said surface the edges of a regular dodecahedron, one of said bald patches being located at the midpoint of each edge of said dodecahedron, wherein each said bald patch is a region on the surface of said ball of such a size that it is possible to draw on it a spherical rectangular dumbbell having a surface area of 1.0 to 2.5 times the mean dimple area and not enclosing any of said dimples or any part of said dimples.

2. The golf ball of claim 1, wherein said dimples are of circular plan view, their configuration being that of a solid of revolution generated by the rotation of a plane curve about a radius of said ball.

3. The golf ball of claim 2, wherein the configuration of said dimples is that of a part-sphere.

4. The golf ball of claim 2, wherein the configuration of said dimples is that of a part-ellipsoid.

5. The golf ball of claim 2, wherein the diameter of said dimples is from 0.085 to 0.150 inches (2.16 to 38.81 mm).

6. The golf ball of claim 5, wherein the diameter of said dimples is from 0.090 to 0.145 inches (2.29 to 3.68 mm).

7. The golf ball of claim 2, wherein the ratio of the maximum depth of said dimples to their diameter is from 1:6 to 1:20.

* * * * *